US011431068B2

(12) United States Patent
Iwanaka et al.

(10) Patent No.: US 11,431,068 B2
(45) Date of Patent: Aug. 30, 2022

(54) FREQUENCY VARIABLE FILTER AND COUPLING METHOD

(71) Applicant: NEC Corporation, Tokyo (JP)

(72) Inventors: Daisuke Iwanaka, Tokyo (JP); Tomoya Kaneko, Tokyo (JP)

(73) Assignee: NEC CORPORATION, Tokyo (JP)

( * ) Notice: Subject to any disclaimer, the term of this patent is extended or adjusted under 35 U.S.C. 154(b) by 0 days.

(21) Appl. No.: 17/325,413

(22) Filed: May 20, 2021

(65) Prior Publication Data

US 2021/0376435 A1 Dec. 2, 2021

(30) Foreign Application Priority Data

May 26, 2020 (JP) ..... JP2020-091431

(51) Int. Cl.
*H01P 1/205* (2006.01)
*H01P 1/202* (2006.01)
*H01P 7/10* (2006.01)

(52) U.S. Cl.
CPC ..... *H01P 1/202* (2013.01); *H01P 1/205* (2013.01); *H01P 7/10* (2013.01)

(58) Field of Classification Search
CPC ..... H01P 1/202; H01P 1/2053; H01P 1/205; H01P 1/207; H01P 1/208; H01P 1/20; H01P 1/2056; H01P 7/10; H01P 7/04; H01P 7/06
See application file for complete search history.

(56) References Cited

U.S. PATENT DOCUMENTS 9,786,974 B2 * 10/2017 Shiroyama ..... H01P 1/2084
2017/0288289 A1 * 10/2017 Zhao ..... H01P 1/207
2021/0028525 A1 * 1/2021 Iwanaka ..... H01P 1/203

FOREIGN PATENT DOCUMENTS

JP H06-334402 A 12/1994
JP 2011-009806 A 1/2011
WO 2017/072813 A1 5/2017

* cited by examiner

*Primary Examiner* — Stephen E. Jones
(74) *Attorney, Agent, or Firm* — Sughrue Mion, PLLC

(57) ABSTRACT

A frequency variable filter includes variable resonators aligned in a predetermined direction, a coupling part configured to couple the adjacent variable resonators, and a coupling variable dielectric. The variable resonator includes a resonator and a frequency variable dielectric disposed in a movable state relative to the resonator, and is configured to be able to change a resonance frequency according to a position of the frequency variable dielectric with respect to the resonator. This applies to aligned variable resonators other than this variable resonator. The coupling variable dielectric is disposed in a movable state with respect to the coupling part and configured to adjust a coupling coefficient according to an amount of insertion into the coupling part. The coupling variable dielectric is disposed so that a movable surface of the coupling variable dielectric is on the same plane as a movable surface of the frequency variable dielectric.

10 Claims, 14 Drawing Sheets

FREQUENCY VARIABLE FILTER AND COUPLING METHOD

INCORPORATION BY REFERENCE

This application is based upon and claims the benefit of priority from Japanese patent application No. 2020-091431, filed on May 26, 2020, the disclosure of which is incorporated herein in its entirety by reference.

TECHNICAL FIELD

The present disclosure relates to a frequency variable filter and a coupling method.

BACKGROUND ART

Recently, upon an increase in a mobile phone traffic demand, a total number of radio frequencies for the mobile phones has been expanded in order to expand a transmission capacity of a network. Since radio frequencies are resources, various frequencies are used in consideration of the coexistence of other services under national and regional laws.

A filter is used in a high-frequency wireless communication apparatus for communicating high-frequency signals in a microwave band or a millimeter wave band in order to prevent or minimize the emission of unwanted waves and the influence of interfering waves. The filter is, for example, a band-pass filter that passes signals in a passband or a band-stop filter that blocks signals in a stopband from passing therethrough. However, wavelengths of high-frequency signals depend on the frequency. For this reason, a high-frequency wireless communication apparatus is required to include a plurality of filters to correspond to various frequencies.

For example, a mobile phone terminal has a smaller transmission power (about 1 W) and a smaller suppression amount than those of a mobile phone base station. Therefore, the mobile phone terminal uses a scheme in which a plurality of filters (about several milliliter(s)) having a relatively large loss but small size, such as a surface acoustic wave filter and a dielectric filter, are mounted for each of a plurality of frequencies, and the plurality of filters are switched.

On the other hand, the transmission power of the mobile phone base station is larger than that of the mobile phone terminal (10 W to 100 W). For this reason, it is necessary to reduce the loss of the filter in the mobile phone base station in order to save the power of the entire base station, and thus the size of the filter becomes large (about several liters). It is thus impractical to implement a plurality of filters for each of a plurality of frequencies in the mobile phone base station. In addition, providing an RF (Radio Frequency) unit and an RRH (Remote Radio Head) separately for each frequency is inconvenient for an operator of the mobile phone base station, because it increases the management cost and the procurement period. In order to address this issue, it is preferable to implement the RF unit and the RRH having a variable frequency, and in order to do so, a frequency variable filter having a variable frequency is effective.

The filter is implemented with a configuration including, for example, a plurality of resonators and a coupling circuit for coupling two adjacent resonators among the plurality of resonators. Further, in order to implement the frequency variable filter with this configuration, it is necessary to make a resonance frequency of the resonators variable, and to appropriately adjust a coupling coefficient between the two adjacent resonators according to a target frequency in order to obtain a desired bandwidth when the resonance frequency is made variable. For example, International Patent Publication No. WO 2017/072813 discloses a variable resonator having a variable resonance frequency and a filter using the variable resonator. In the technique described in International Patent Publication No. WO 2017/072813, when a center frequency of the filter is increased, a coupling coefficient between the resonators is monotonically increased or constant, and a bandwidth of the filter is increased in proportion to the center frequency.

However, even if the center frequency changes, the transmission and reception bandwidth of an apparatus is constant or a predetermined bandwidth and is not proportional to the center frequency. For example, the channel bandwidth in the standardization of 3GPP (Third Generation Partnership Project) is a combination of 5, 10, 15, and 20 MHz, and does not expand in proportion to the center frequency. The same applies to microwave communications. For example, according to the ITU-R (International Telecommunication Union-Radiocommunication Sector), channel bandwidths of 3.5, 7, 14, 28, and 56 MHz can be used for both the 7 GHz and 15 GHz bands, and the channel bandwidths do not increase in proportion to the center frequency. Thus, an increase in the bandwidth of the filter due to an increase in the center frequency of the filter is inconvinient for an operator of the apparatus such as an operator of mobile phones.

Japanese Unexamined Patent Application Publication No. H06-334402 discloses a technique in which a space between a pair of resonators is surrounded by open end faces of the pair of resonators and a conductor casing, a through-hole is formed in a part of the conductor casing, a dielectric such as ceramic is inserted therein, and a dielectric constant between the resonators is changed to adjust a coupling coefficient.

Japanese Unexamined Patent Application Publication No. 2011-009806 discloses a tunable band-pass filter in which a dielectric plate is inserted and installed, an electrical length in an H plane direction is varied by changing the angle formed by the metal plate to change a resonance frequency. In the filter described in Japanese Unexamined Patent Application Publication No. 2011-009806, it is possible to apply, to the dielectric plate, a flap motion around a "rod" which is a coupling part connected to a drive unit, or a parallel movement along a propagation direction of electromagnetic waves.

SUMMARY

As described above, the technique described in Japanese Unexamined Patent Application Publication No. H06-334402 is not a technique related to a frequency variable filter. In the technique disclosed in Japanese Unexamined Patent Application Publication No. 2011-009806, the center frequency of the band-pass filter is varied by rotating or vertically moving the dielectric.

The present inventors has considered a configuration in which the technique disclosed in Japanese Unexamined Patent Application Publication No. H06-334402 and the technique disclosed in Japanese Unexamined Patent Application Publication No. 2011-009806 are combined so as to have a function of changing the target frequency while suppressing a fluctuation of the bandwidth. However, even when such a configuration is achieved by the combination of Japanese Unexamined Patent Application Publication Nos. H06-334402 and 2011-009806, the configuration is not simple and the target frequency cannot be easily changed while suppressing the fluctuation of the bandwidth.

In view of the above problem, an object of the present disclosure is to provide a frequency variable filter which has a simple structure and can be configured so as to have a function of easily changing a target frequency while suppressing a fluctuation of a bandwidth, and a coupling method for coupling variable resonators in the frequency variable filter.

A first example aspect of the present disclosure is a frequency variable filter including: a plurality of variable resonators aligned in a predetermined direction and configured to be able to change a resonance frequency; a coupling part configured to couple the adjacent variable resonators among the plurality of variable resonators; and a coupling variable dielectric disposed in a movable state with respect to the coupling part and configured to adjust a coupling coefficient according to an amount of insertion into the coupling part. The variable resonator includes a resonator and a frequency variable dielectric disposed in a movable state relative to the resonator, and is configured to be able to change the resonance frequency according to a position of the frequency variable dielectric with respect to the resonator, and the coupling variable dielectric is disposed so that a movable surface of the coupling variable dielectric is on the same plane as a movable surface of the frequency variable dielectric.

A second example aspect of the present disclosure is a method for coupling a plurality of variable resonators in a frequency variable filter including the plurality of variable resonators configured to be able to change a resonance frequency, the method comprising coupling and disposing. The variable resonator includes a resonator and a frequency variable dielectric disposed in a movable state relative to the resonator, and is configured to be able to change the resonance frequency according to a position of the frequency variable dielectric with respect to the resonator. The coupling is coupling the adjacent variable resonators among the plurality of variable resonators aligned in a predetermined direction. The disposing is disposing a coupling variable dielectric in a movable state with respect to a coupling part so that a coupling coefficient is adjusted according to an amount of insertion into the coupling part and disposing the coupling variable dielectric so that a movable surface of the coupling variable dielectric is on the same plane as a movable surface of the frequency variable dielectric.

BRIEF DESCRIPTION OF DRAWINGS

The above and other aspects, features and advantages of the present disclosure will become more apparent from the following description of certain exemplary example embodiments when taken in conjunction with the accompanying drawings, in which.

EXAMPLE EMBODIMENT

Figure 1:
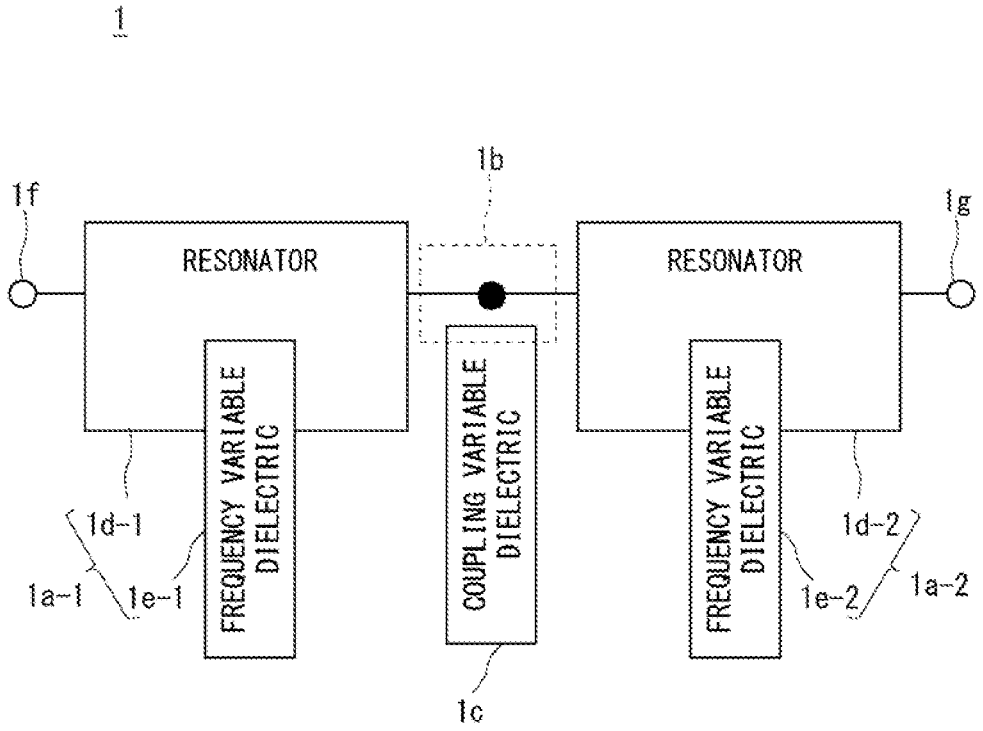
FIG. 1 is a block diagram showing a configuration example of a frequency variable band-pass filter according to a first example embodiment.

Example embodiments of the present disclosure will be described below with reference to the drawings. The following descriptions and drawings are omitted and simplified as appropriate for clarity of explanation. In the following drawings, the same elements are denoted by the same reference numerals, and repeated description is omitted as necessary. Further, the specific numerical values and the like shown below are merely examples for facilitating understanding of the disclosure and are not limited to them. Each of the example embodiments described below is an example in which a frequency variable filter according to the present disclosure is a frequency variable band-pass filter having a variable pass center frequency.

First Example Embodiment

FIG. 1 is a block diagram showing a configuration example of a frequency variable band-pass filter according to a first example embodiment.

As shown in FIG. 1, a frequency variable band-pass filter 1 according to this example embodiment includes a plurality of variable resonators 1*a*-1 and 1*a*-2 aligned in a predetermined direction and capable of changing a resonance frequency, a coupling part 1*b*, and a coupling variable dielectric 1*c*. The predetermined direction may be a direction along one straight line, but is not limited to this.

The frequency variable band-pass filter 1 may include two input/output terminals 1*f* and 1*g*. The input/output terminals 1*f* and 1*g* are terminals for inputting and outputting signals which are generally high-frequency signals. One of the input/output terminals if and lg operates as an input terminal and the other operates as an output terminal. For example, when the input/output terminal 1*f* operates as an input terminal and the input/output terminal 1*g* operates as an output terminal, a high-frequency signal is input to the input/output terminal 1*f*, and only a high-frequency signal within the pass band of the frequency variable band-pass filter 1 is output from the input/output terminal 1*g*.

The variable resonator 1*a*-1 includes a resonator 1*d*-1 and a frequency variable dielectric 1*e*-1 disposed in a movable state relative to the resonator 1*d*-1, and is configured to be able to change the resonance frequency by the position of the frequency variable dielectric 1*e*-1 with respect to the resonator 1*d*-1. Similarly, the variable resonator 1*a*-2 includes a resonator 1*d*-2 and a frequency variable dielectric 1*e*-2 disposed in a movable state relative to the resonator 1*d*-2, and is configured to be able to change the resonance frequency by the position of the frequency variable dielectric 1*e*-2 with respect to the resonator 1*d*-2.

Hereinafter, the variable resonators 1*a*-1 and 1*a*-2 are also referred to as simply "variable resonators 1*a*", when they are mentioned without particular distinction between them. Similarly, the resonators 1*d*-1 and 1*d*-2 are also referred to as simply "resonators 1*d*", and the frequency variable dielectrics 1*e*-1 and 1*e*-2 are also referred to as simply "frequency variable dielectrics 1*e*". Also in second example embodiment and the subsequent example embodiments, when the components provided with branch numbers are mentioned without particular distinction between them, the branch numbers of those components will be omitted.

The coupling part 1*b* couples the adjacent variable resonators 1*a*, and may also be referred to as a coupling circuit. The coupling part 1*b* couples the variable resonators 1*a*-1 and 1*a*-2 and, for example, may be configured to connect the variable resonator 1*a*-1 to the variable resonator 1*a*-2.

As described above, the frequency variable band-pass filter 1 is a two-stage band-pass filter having two variable resonators 1*a*. However, the number of stages of the variable resonators 1*a* may be three or more, and in this case, the coupling part 1*b* and the coupling variable dielectric 1*c* are disposed between each pair of the adjacent variable resonators 1*a*.

One of the main features of this example embodiment is that the coupling variable dielectric 1*c* is disposed in a state movable relative to the coupling part 1*b* and adjusts the coupling coefficient according to an amount of insertion of the coupling variable dielectric 1*c* into the coupling part 1*b*. As described above, the frequency variable band-pass filter 1 is a frequency variable filter, and is a filter capable of varying coupling, i.e., a specific bandwidth, by dielectrics.

In the frequency variable band-pass filter 1 having such a configuration, by controlling not only the position of the frequency variable dielectric 1*e* but also the position of the coupling variable dielectric 1*c*, the pass frequency can be changed while suppressing the fluctuation of the pass bandwidth. More specifically, in the frequency variable band-pass filter 1, first the pass frequency can be variably controlled by controlling the position of the frequency variable dielectric 1*e*. Further, in the frequency variable band-pass filter 1, by controlling the amount of insertion of the coupling variable dielectric 1*c* disposed in the coupling part 1*b* between the variable resonators 1*a*, the coupling coefficient between the variable resonators 1*a* can be adjusted to a desired value, and the pass bandwidth can be designed to be constant or a predetermined bandwidth. For example, by determining and controlling the center frequency as the pass frequency and controlling the amount of insertion of the coupling variable dielectric 1*c* for each center frequency (according to its center frequency), a desired coupling coefficient can be achieved, and a filter bandwidth can be controlled.

In particular, it is preferable that the frequency variable band-pass filter 1 include a control unit for controlling the amount of insertion of the coupling variable dielectric 1*c* according to a position of the frequency variable dielectric 1*e* relative to the resonator 1*d* so that the bandwidth to be passed becomes substantially constant irrespective of the position of the frequency variable dielectric 1*e* relative to the resonator 1*d*. However, the control unit may perform control so that the specific bandwidth becomes substantially constant instead of the bandwidth.

Further, as one of the main features of this example embodiment, the coupling variable dielectric 1*c* is provided so that a movable surface of the coupling variable dielectric 1*c* is on the same plane as the movable surfaces of the frequency variable dielectric 1*e*-1 and 1*e*-2 (in the same plane). That is, in the frequency variable band-pass filter 1, the coupling variable dielectric 1*c* and the frequency variable dielectric 1*e* are disposed so that their movable surfaces are on the same plane.

With this arrangement of dielectrics, it is possible to form a frequency variable band-pass filter having the function of easily changing the pass frequency while suppressing the variation of the pass bandwidth by controlling the position of the coupling variable dielectric 1*c* with a simple structure.

A method for coupling the plurality of variable resonators 1*a* in the above-described frequency variable band-pass filter 1 will be briefly described. Here, as described above, the variable resonator 1*a* includes the resonator 1*d* and the frequency variable dielectric 1*e* disposed in a movable state relative to the resonator 1*d*, and is configured to be able to change the resonance frequency by the position of the frequency variable dielectric 1*e* with respect to the resonator 1*d*. In the coupling method, the adjacent variable resonators 1*a* are coupled in a state where the plurality of variable resonators 1*a* are aligned in the predetermined direction. Further, in the coupling method, the coupling variable dielectric 1*c* is provided in a state in which the coupling coefficient can be adjusted in accordance with the amount of insertion into the coupling part 1*b*, and the movable surface of the coupling variable dielectric 1*c* is provided on the same plane as the movable surface of the frequency variable dielectric 1*e*. By employing such a coupling method, the frequency variable band-pass filter having the above function can be formed with a simple structure.

Second Example Embodiment

Figure 2:
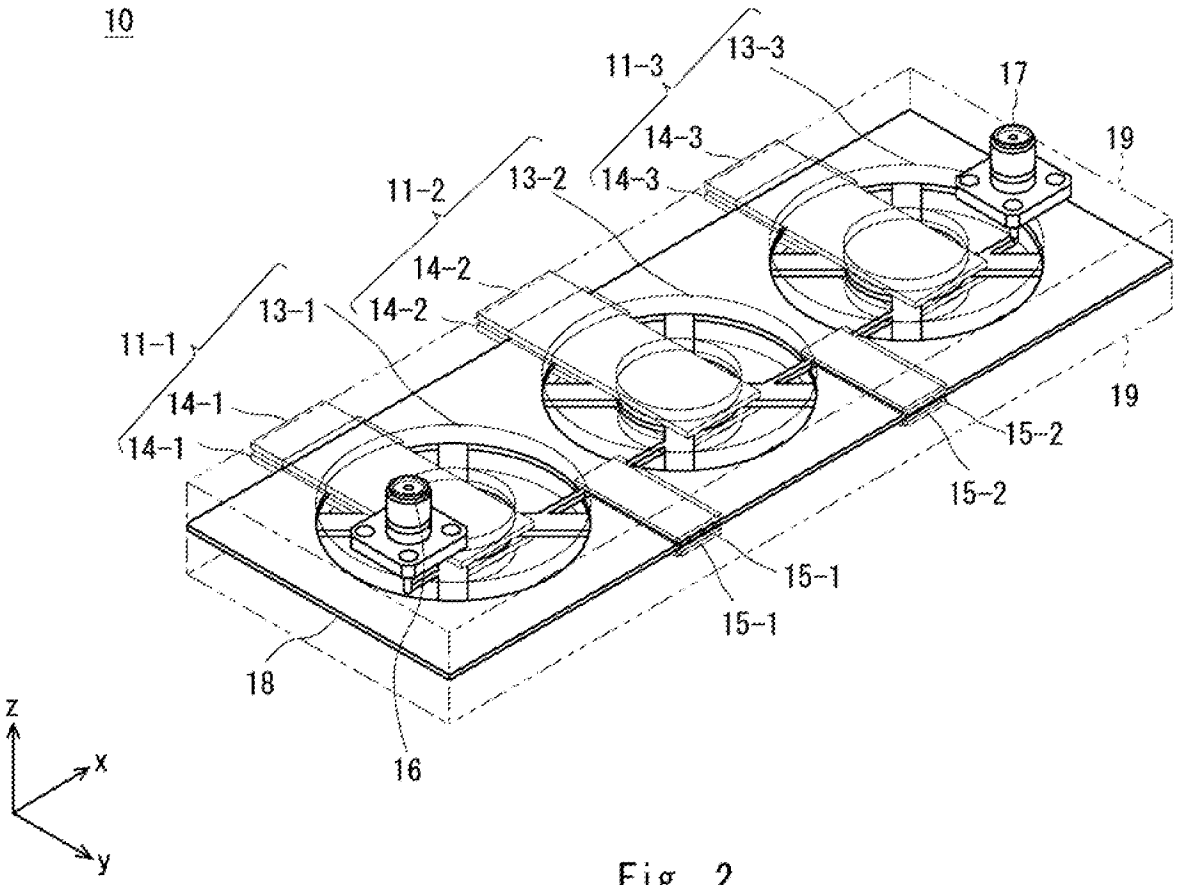
FIG. 2 is a partially transparent perspective view showing a configuration example of a frequency variable band-pass filter according to a second example embodiment.
Figure 3:
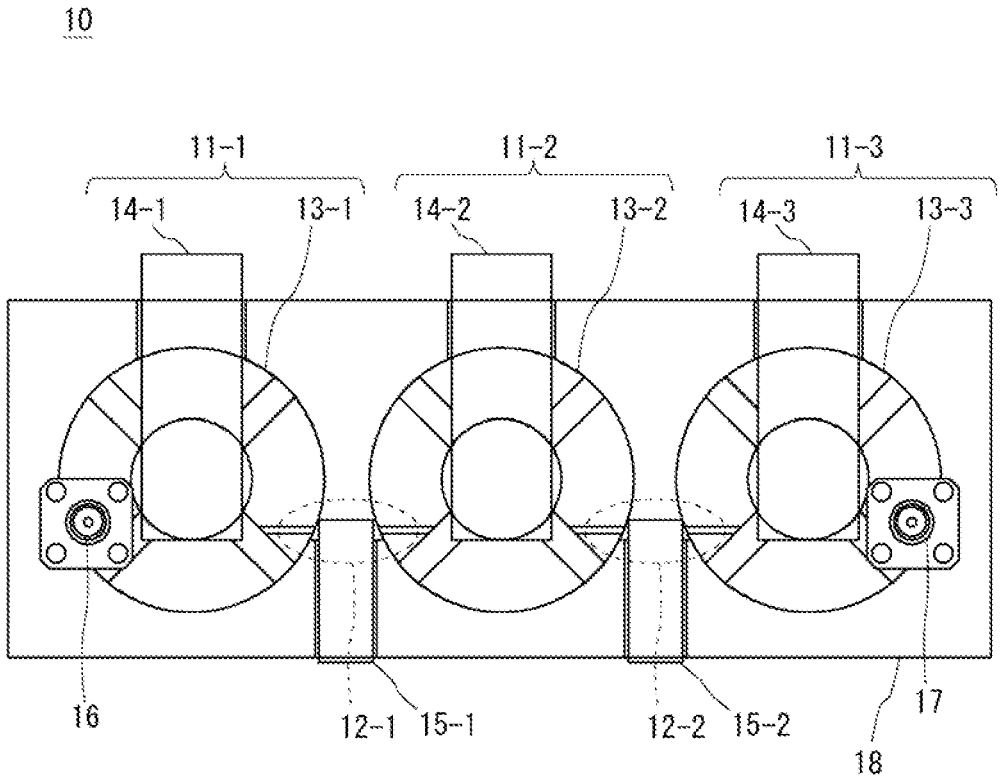
FIG. 3 is a partially transparent top view of the frequency variable band-pass filter of FIG. 2.

A second example embodiment will be described mainly with reference to FIGS. 2 to 9, focusing on the differences from the first example embodiment. Various examples described in the first example embodiment can also be applied to the second example embodiment. FIG. 2 is a partially transparent perspective view showing a configuration example of a frequency variable band-pass filter according to this example embodiment, and FIG. 3 is a top view thereof. In FIGS. 2 and 3, an outer conductor is shown transparently in order to show an inner structure clearly. In this example embodiment, the components having the same names as those of the first example embodiment correspond to examples of the corresponding components of the first example embodiment.

As shown in FIGS. 2 and 3, a frequency variable band-pass filter 10 according to this example embodiment includes three variable resonators 11-1 to 11-3 capable of changing a resonance frequency, two coupling parts (coupling circuits) 12-1 and 12-2, and two coupling variable dielectrics 15-1 and 15-2. The three variable resonators 11-1 to 11-3 are aligned in a predetermined direction. The predetermined direction may be a direction along one straight line (an x direction in FIG. 2) as shown in the drawing, but is not limited to this. The frequency variable band-pass filter 10 may include two input/output terminals 16 and 17.

The frequency variable band-pass filter 10 shown in this example embodiment is a band-pass filter having a 3-stage configuration including three variable resonators 11. However, the number of stages of the variable resonators 11 may be two or more.

The variable resonator 11-1 includes a resonator 13-1 and a frequency variable dielectric 14-1 disposed in a movable state relative to the resonator 13-1, and is configured to be able to change the resonance frequency by the position of the frequency variable dielectric 14-1 with respect to the resonator 13-1. Similarly, the variable resonators 11-2 and 11-3 also include resonators 13-2 and 13-3, and frequency variable dielectrics 14-2 and 14-3 disposed in a movable state relative to the resonators 13-2 and 13-3, respectively. Similarly, the variable resonators 11-2 and 11-3 are configured to be able to change the resonance frequency by the positions of the frequency variable dielectrics 14-2 and 14-3 with respect to the resonators 13-2 and 13-3, respectively. Thus, the three frequency variable dielectrics 14-1 to 14-3 are provided corresponding to the three resonators 13-1 to 13-3, respectively.

As shown in FIGS. 2 and 3, each of the resonators 13-1 to 13-3 is a hollow cylindrical member, and includes a disk-shaped conductor inside hollow cylindrical member. The resonators 13-1 to 13-3 are aligned in the x direction, and their disk-shaped conductors inside are connected by the coupling parts 12 as will be described later.

At one end of each of the frequency variable dielectrics 14, the disk-shaped conductor inside the corresponding resonator 13 is sandwiched in a vertical direction (a z direction), and the other end of each of the frequency variable dielectrics 14 extends in a direction (a y direction) substantially perpendicular to the direction in which the three resonators 13-1 to 13-3 are aligned (the x direction). The other ends of the frequency variable dielectrics 14-1 to 14-3 are connected to a drive unit such as a motor, which is provided outside the frequency variable band-pass filter 10, and the frequency variable dielectrics 14-1 to 14-3 can be driven in the y direction by the drive unit. The drive unit can be controlled by the above-described control unit. By doing so, areas where the frequency variable dielectrics 14 and the disk-shaped conductors inside the resonators 13 overlap can be varied. Therefore, by adjusting these areas, the resonance frequencies of the variable resonators 11 change, thereby changing the pass center frequency of the frequency variable band-pass filter 10 consequently.

Note that an example in which a pair of upper and lower components is provided for each of the resonators 13-1 to 13-3 and the frequency variable dielectrics 14-1 to 14-3 with a metal plate 18 interposed therebetween has been shown. However, the present disclosure is not limited to this, and instead only an upper or lower component may be provided. It can be said that the metal plate 18 includes the disk-shaped conductor inside the resonator 13, and is disposed to form the disk-shaped conductor.

The coupling part 12 couples the adjacent variable resonators 11. The coupling part 12-1 couples the variable resonator 11-1 to the variable resonator 11-2 and, for example, may be configured to connect the variable resonator 11-1 to the variable resonator 11-2. The coupling part 12-2 couples the variable resonators 11-2 to the variable resonator 11-3 and, for example, may be configured to connect the variable resonator 11-2 to the variable resonator 11-3. For example, an external conductor (i.e., a part of the metal plate 18) may be disposed between the adjacent resonators 13, and the disk-shaped conductors inside the adjacent resonators 13 can be connected to each other by a line (see a comparative example of FIG. 4, which will be described later) passing inside of the external conductor.

The coupling variable dielectric 15 is disposed in a movable state relative to the coupling part 12, and adjusts the coupling coefficient according to the amount of insertion into the coupling part 12. It is desirable to use a low-loss dielectric such as alumina for the frequency variable dielectrics 14 and the coupling variable dielectrics 15.

At one end of each of the coupling variable dielectrics 15, the line of the corresponding coupling part 12 is sandwiched in the vertical direction (the z direction), and the other end of each of the coupling variable dielectrics 15 extends in a direction (the y direction) substantially perpendicular to the direction in which the three resonators 13-1 to 13-3 are aligned (the x direction). The other ends of the coupling variable dielectrics 15-1 and 15-2 are connected to a drive unit such as a motor, which is provided outside the frequency variable band-pass filter 10, and the coupling variable dielectrics 15-1 and 15-2 can be driven in the y direction by the drive unit. The drive unit can be controlled by the above-described control unit. By doing so, areas where the coupling variable dielectrics 15 and the lines of the coupling parts 12 overlap can be varied. Therefore, by adjusting these areas, the coupling coefficients change, thereby changing the pass bandwidth of the frequency variable band-pass filter 10 consequently. In a manner similar to the example in which a pair of components is provided for each of the resonators 13-1 and 13-2, an example in which a pair of lower and upper components is provided for each of the coupling variable dielectrics 15-1 and 15-2 with the metal plate 18 interposed therebetween is shown. However, the present disclosure is not limited to this.

The three variable resonators 11, the two coupling parts 12, the two coupling variable dielectrics 15, the input/output terminals 16 and 17, and the metal plate 18 can be accommodated in an outer conductor 19. However, both the coupling variable dielectrics 15 and the frequency variable dielectric 14 can be accommodated in a state in which a part thereof is exposed to the outside of the outer conductor 19 according to their positions. The input/output terminals 16 and 17 can be partially led out of the outer conductor 19.

As described above, the frequency variable band-pass filter 10 according to this example embodiment is also a frequency variable filter, and is capable of varying the coupling, i.e., a specific bandwidth, by dielectrics. That is, in the frequency variable band-pass filter 10 having such a configuration, by controlling not only the position of the frequency variable dielectric 14 but also the position of the coupling variable dielectric 15, the pass frequency can be changed while suppressing the fluctuation of the pass bandwidth.

More specifically, in the frequency variable band-pass filter 10, first the pass frequency can be variably controlled by changing the position of the frequency variable dielectric 14. Further, in the frequency variable band-pass filter 10, by controlling the amount of insertion of the coupling variable dielectric 15 disposed in the coupling part 12 between the variable resonators 11, the coupling coefficient between the variable resonators 11 can be adjusted to a desired value, and the pass bandwidth can be designed to be constant or a predetermined bandwidth. For example, by determining and controlling the center frequency as the pass frequency and controlling the amount of insertion of the coupling variable dielectric 15 for each center frequency (according to its center frequency), a desired coupling coefficient can be achieved, and the filter bandwidth can be controlled.

In particular, in this example embodiment, as shown in the y-axis direction for any of the movable axes, the coupling variable dielectrics 15-1 and 15-2 are provided so that all of the movable axes are directed in the same direction as those of the movable axes of the frequency variable dielectrics 14-1 and 14-2. That is, in the frequency variable band-pass filter 10, the coupling variable dielectrics 15 and the frequency variable dielectrics 14 are disposed so that their movable axes are directed in the same direction.

In the example described here, a pair of lower and upper components is provided for each of the coupling variable dielectrics 15-1 and frequency variable dielectrics 14-1 and 14-2 with the metal plate 18 interposed therebetween. Therefore, the movable axes of the upper coupling variable dielectric 15-1 and the upper frequency variable dielectrics 14-1 and 14-2 are directed in the same direction, and the movable axes of the lower coupling variable dielectric 15-1 and the lower frequency variable dielectrics 14-1 and 14-2 are directed in the same direction. The same applies to the coupling variable dielectric 15-2 and the frequency variable dielectrics 14-2 and 14-3.

In particular, in this example embodiment, since the movable axes of the two dielectrics 14 and 15 are directed in the same direction as described above, the following control becomes easy. Specifically, it is possible to accurately perform control as compared to that in an example in which the movable surfaces of the two dielectrics 14 and 15 are provided on the same plane (as compared to an example in which the movable axes of the two dielectrics 14 and 15 are not directed in the same direction).

The coupling parts 12 can be configured to be in a TEM (Transverse ElectroMagnetic) mode. In the coupling parts 12 shown in FIG. 3, in a manner similar to coupling parts 112 shown in FIG. 4, which will be described later, a thin part of the metal plate 18 connecting the resonators 13 serves as an inner conductor, and an outer part of the thin part of the metal plate 18 serves as an outer conductor, so that electromagnetic waves can propagate in the TEM mode. However, the coupling parts 12 may not be configured to be in the TEM mode. In this manner, each of the coupling part 12 can conssitute a coaxial transmission line with the inner conductor and the outer conductor, and the coupling coefficient can be varied by bringing the coupling variable dielectric 15 close to or away from the inner conductor (a coaxial center conductor) in such a coaxial structure along a certain plane.

The resonators 13 are configured to include a CRLH (Composite right/left-handed) circuit), namely, configured as a CRLH resonator. The CRLH resonator can have a structure composed by cutting a part of a left-handed coaxial line as described, for example, in International Patent Publication No. WO 2017/072813. In this structure, a capacitor is formed between the fragmented center conductors, and the fragmented center conductors are connected to the outer conductors by an inductor. The structure of the CRLH resonator is not limited to this. In addition, although it is preferable that each of the resonators 13 include a Composite right/left-handed circuit in order to improve compatibility in design and practical use in order to provide the functions described above, the present disclosure is not limited to the above one.

Further, the illustrated coupling part 12 has a structure in which the Composite right/left-handed lines of the adjacent resonators 13 are directly connected to each other so that the cylinders of the metal plates 18 which are to be a part of the adjacent resonators 18 are directly connected to each other as a part of the resonators 13. However, the coupling method is not limited to this, and instead a coupling method such as coupling by an iris or a coupling window may be used.

Next, an operation of the frequency variable band-pass filter 10 according to this example embodiment will be described in comparison with a frequency variable band-pass filter 100 according to the comparative example shown in FIG. 4. In the frequency variable band-pass filter 10, the frequency variable dielectrics 14-1 to 14-3 are driven in the y direction to adjust the areas where the frequency variable dielectrics 14 and the disk-shaped conductors inside the resonator 13 overlap. By such adjustment, the resonance frequency of the variable resonator 11 changes, and as a result, the pass center frequency of the frequency variable band-pass filter 10 changes.

Here, in the frequency variable band-pass filter 10, the coupling parts 12 for coupling each of the two adjacent variable resonators 11 are connected between each of the two adjacent variable resonators 11 (more specifically, between each of the two adjacent resonators 13).

Figure 4:
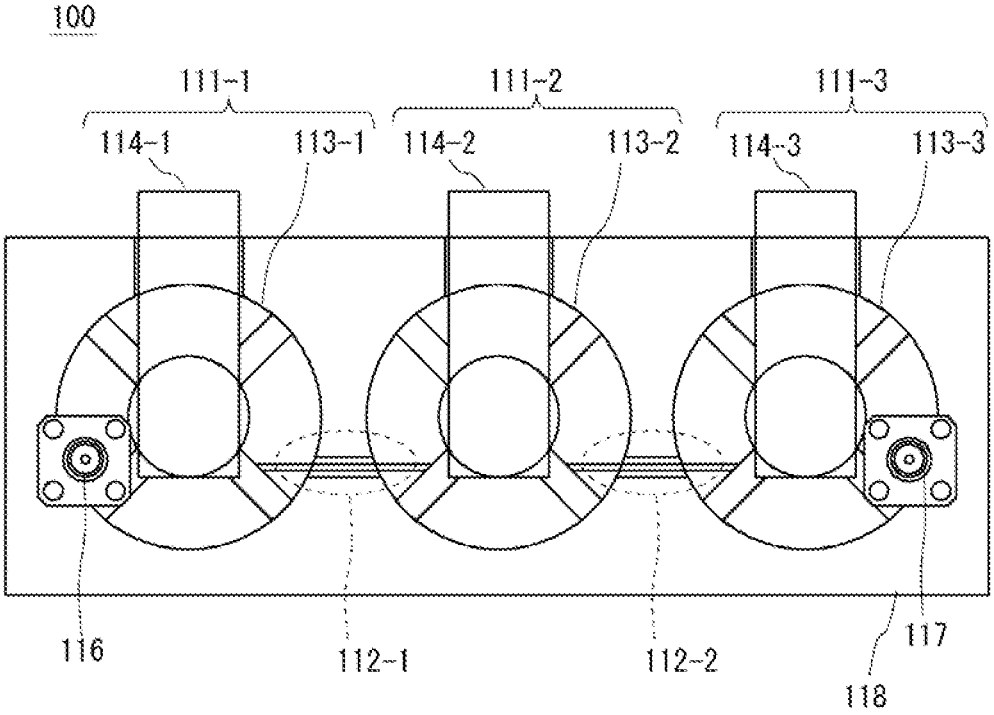
FIG. 4 is a partially transparent top view of a frequency variable band-pass filter according to a comparative example.

FIG. 4 is a partially transparent top view showing the frequency variable band-pass filter 100 according to the comparative example. The frequency variable band-pass filter 100 is the same as the frequency variable band-pass filter 10 of FIG. 2 except that the coupling variable dielectrics 15 are not provided in the frequency variable band-pass filter 100. Components of the frequency variable band-pass filter 100 in FIG. 4 that correspond to components of the frequency variable band-pass filter in FIGS. 2 and 3 are denoted by the same reference signs as those denoting such components in FIGS. 2 and 3 plus 100. Therefore, description of each component of the frequency variable band-pass filter 100 is omitted.

Figure 5:
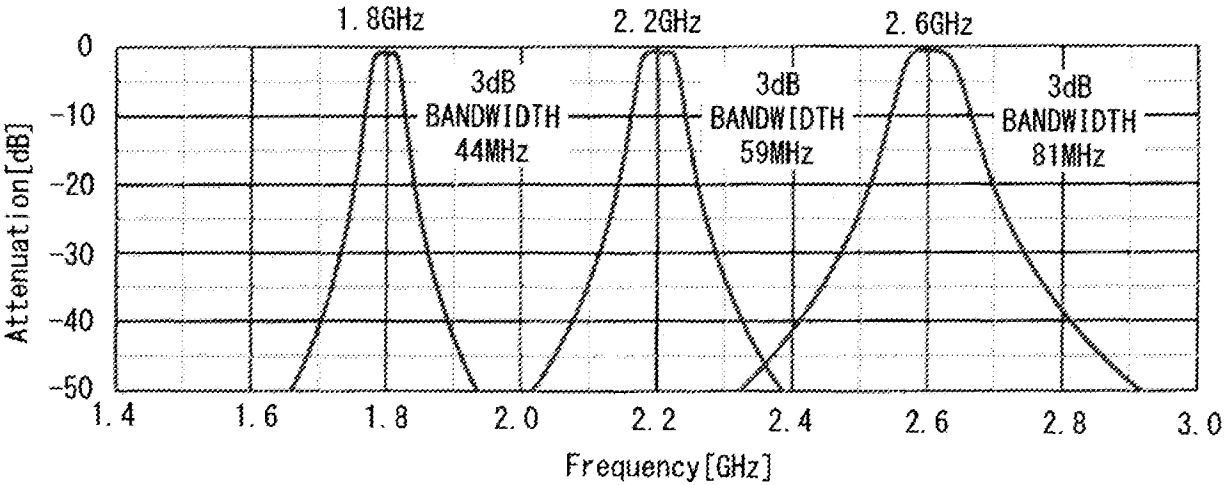
FIG. 5 is a diagram showing an example of a pass characteristic when a center frequency of the frequency variable band-pass filter according to the comparative example of FIG. 4 is varied by a frequency variable dielectric.

FIG. 5 is a diagram showing an example of a pass characteristic in the case in which a center frequency of the frequency variable band-pass filter 100 according to the comparative example of FIG. 4 is varied by frequency variable dielectrics 114. As shown in FIG. 5, in the frequency variable band-pass filter 100, the 3 dB bandwidth is 44 MHz at 1.8 GHz, while the 3 dB bandwidth is 81 MHz at 2.6 GHz, and it can be seen that the bandwidth is expanded so as to be approximately doubled.

Figure 6:
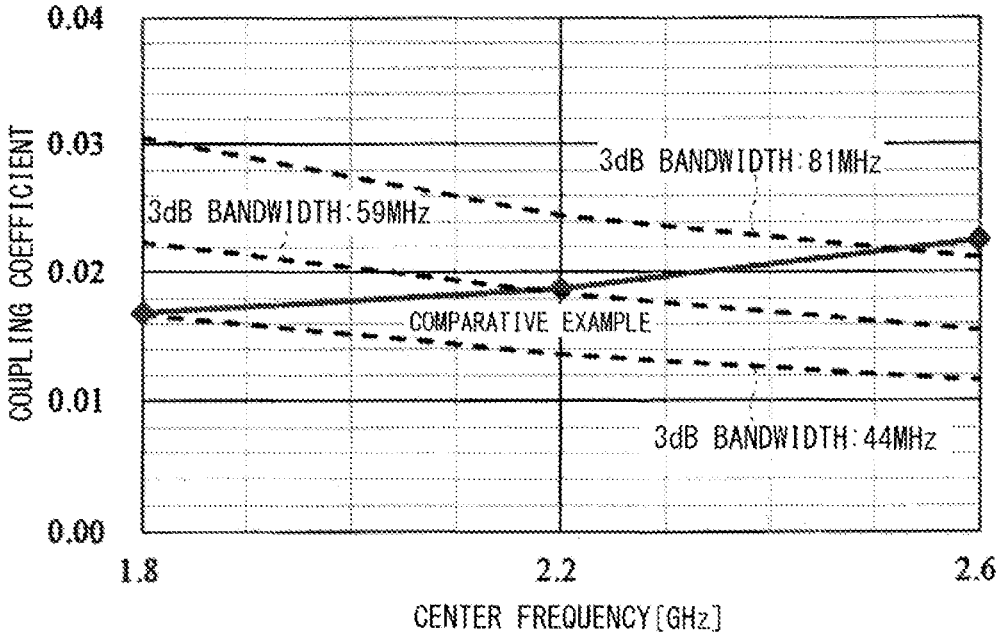
FIG. 6 shows an example of coupling coefficients necessary to keep a coupling coefficient between resonators and a bandwidth constant in the frequency variable band-pass filter according to the comparative example of FIG. 4.

The reason why the bandwidth is expanded when the frequency is increased will be explained using the coupling coefficient between the resonators. FIG. 6 is a diagram showing an example of the coupling coefficients necessary to keep the coupling coefficient and the bandwidth between resonators constant in the comparative example. The solid line shows the coupling coefficient between resonators when the frequency is variable, and the dotted lines show the coupling coefficients necessary to keep the bandwidth constant, and the coupling coefficients necessary for 3 dB bandwidth of 81 MHz, 59 MHz, and 44 MHz are shown from the top. In FIG. 6, the coupling coefficients necessary to keep the bandwidth constant are shown under the condition of a 3-stage band-pass filter and a ripple of 0.01 dB, with three examples of the bandwidth. If the coupling coefficient monotonically decreases along the dotted lines when the frequency is variable, the bandwidth can be kept constant. However, in the comparative example, the bandwidth is monotonically increased, so that the bandwidth is expanded when the frequency is increased. In order to keep the bandwidth constant when the frequency is variable, it is necessary to adjust the coupling coefficient so as to obtain a desired coupling coefficient corresponding to the frequency. The problem that the bandwidth changes when the center frequency is made variable is a general phenomenon.

On the other hand, in the frequency variable band-pass filter 10 according to this example embodiment, by controlling the amount of insertion of the dielectric disposed at the coupling part between the resonators, the coupling coefficient between the resonators can be adjusted to a desired value, and the bandwidth can be made constant. Since the coupling coefficient increases as the amount of insertion of the coupling variable dielectric increases (as the amount of overlap between the coupling line between the resonators and the coupling variable dielectric increases), the monotonically decreasing characteristic can be achieved by increasing the amount of insertion of the coupling variable dielectric when the frequency is low and decreasing the amount of insertion of the coupling variable dielectric as the frequency increases.

Figure 7:
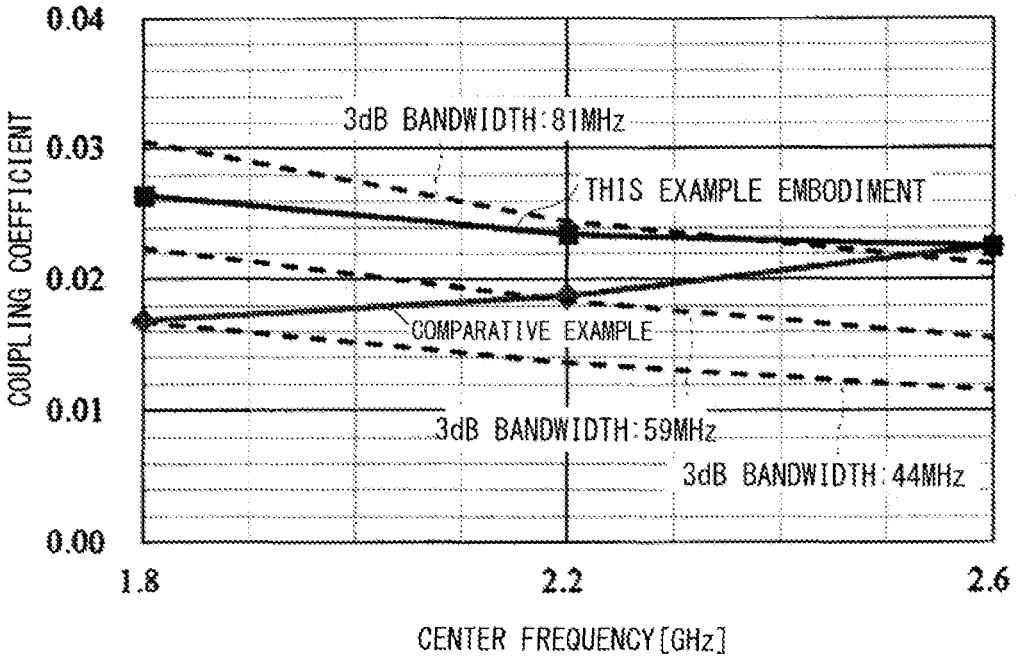
FIG. 7 is a diagram showing an example of a coupling coefficient necessary to keep the coupling coefficient and the bandwidth between resonators constant in the frequency variable band-pass filter of FIGS. 2 and 3 and the frequency variable band-pass filter according to the comparative example of FIG. 4.

FIG. 7 shows FIG. 6 with an example of the coupling coefficient for the frequency variable band-pass filter 10 of FIGS. 2 and 3 added thereto. As shown in FIG. 7, it is understood that the frequency variable band-pass filter 10 according to this example embodiment can achieve the characteristic of monotonous decrease.

Figure 8:
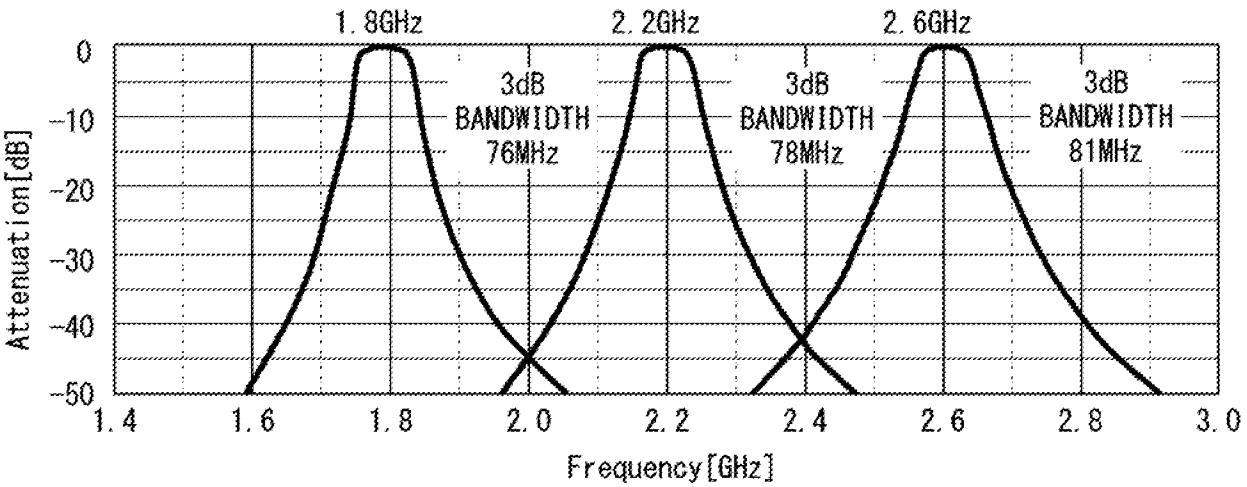
FIG. 8 shows an example of a pass characteristic of the frequency variable band-pass filter of FIGS. 2 and 3.
Figure 9:
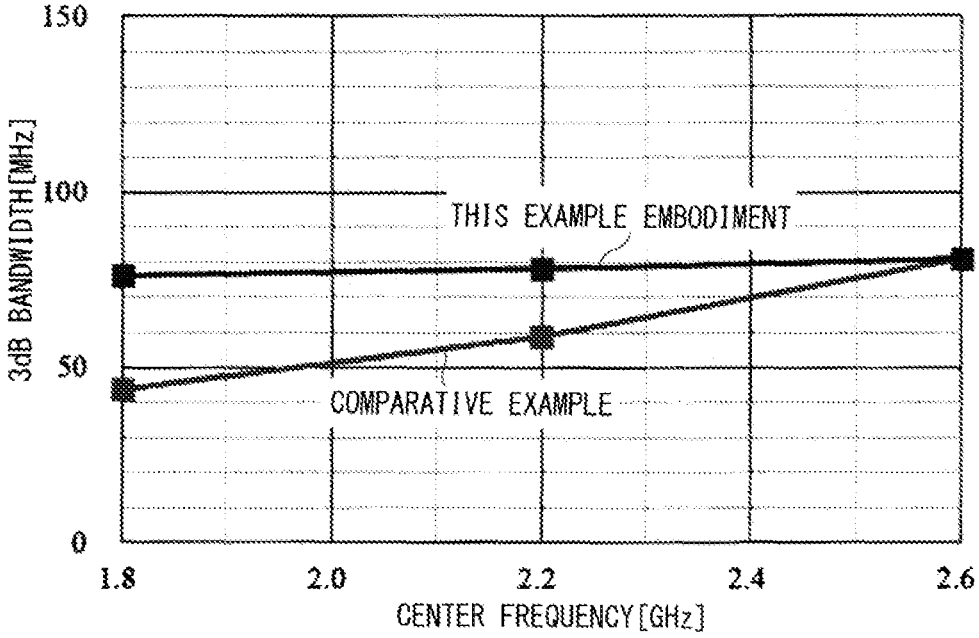
FIG. 9 is a diagram showing 3 dB bandwidths when frequencies are variable for the frequency variable band-pass filter of FIGS. 2 and 3 and the frequency variable band-pass filter of the comparative example of FIG. 4.

FIG. 8 is a diagram showing an example of the pass characteristic of the frequency variable band-pass filter 10. As shown in FIG. 8, in the frequency variable band-pass filter 10, the 3 dB bandwidth is 76 MHz at 1.8 GHz, while the 3 dB bandwidth is 81 MHz at 2.6 GHz, and the fluctuation of the bandwidth can be suppressed to 5 MHz. FIG. 9 is a diagram showing 3 dB bandwidths of the frequency variable band-pass filter 10 of FIGS. 2 and 3 and the frequency variable band-pass filter 100 according to the comparative example of FIG. 4 when the frequency is variable. As shown in FIG. 9, the fluctuation of the bandwidth in this example embodiment is 6.5% (specifically, (81-76)/76 MHz), which is greatly suppressed in comparison with 84% (specifically, (81-44)/44 MHz) of the comparative example.

As described above, in this example embodiment, by controlling the amount of insertion of the coupling variable dielectrics 15 disposed in the coupling parts according to the frequency, it is possible to adjust the coupling coefficient between the variable resonators 11 and to make the filter bandwidth substantially constant.

Third Example Embodiment

Figure 10:
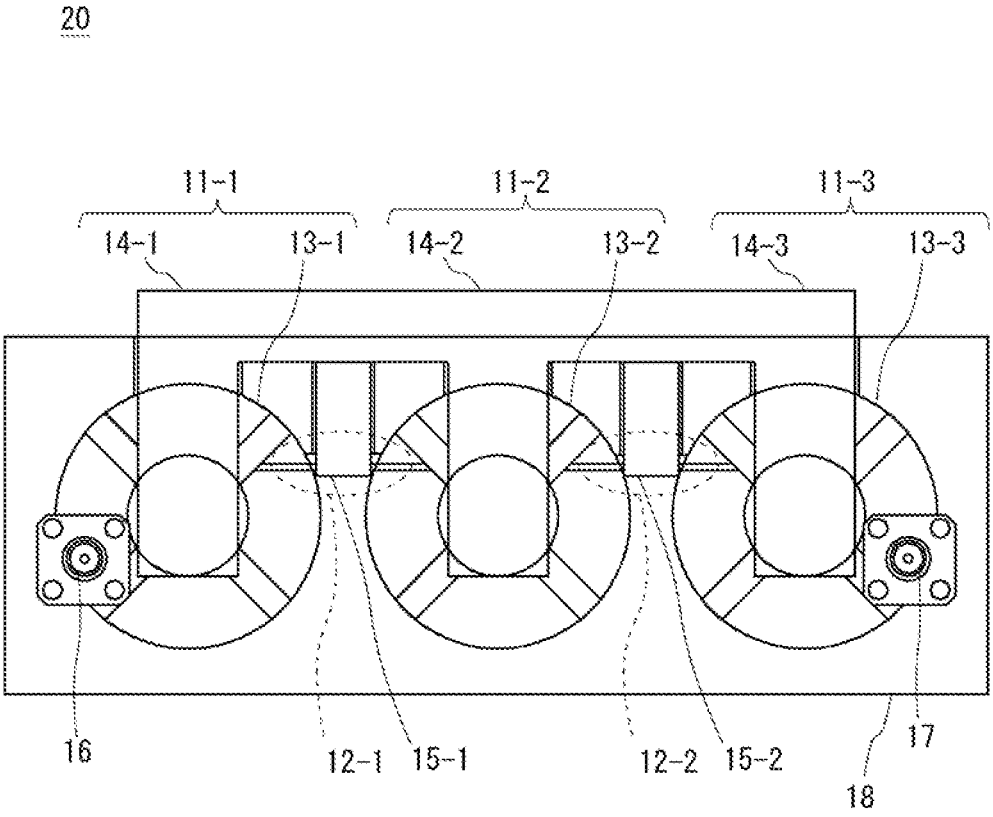
FIG. 10 is a partially transparent top view showing a configuration example of a frequency variable band-pass filter according to a third example embodiment.

A third example embodiment will be described with reference to FIGS. 10 to 14, focusing on the differences from the second example embodiment. Various examples described in the first and second example embodiments can also be applied to the third example embodiment. FIG. 10 is a partially transparent top view showing a configuration example of the frequency variable band-pass filter according to this example embodiment.

As shown in FIG. 10, a frequency variable band-pass filter 20 according to this example embodiment has a structure in which the frequency variable dielectrics 14 and the coupling variable dielectrics 15 are integrated or combined. As in this example, since the coupling variable dielectrics and the frequency variable dielectrics are disposed so as to be integrally movable, it is possible to control the coupling variable dielectrics and the frequency variable dielectrics by one drive unit.

Figure 11:
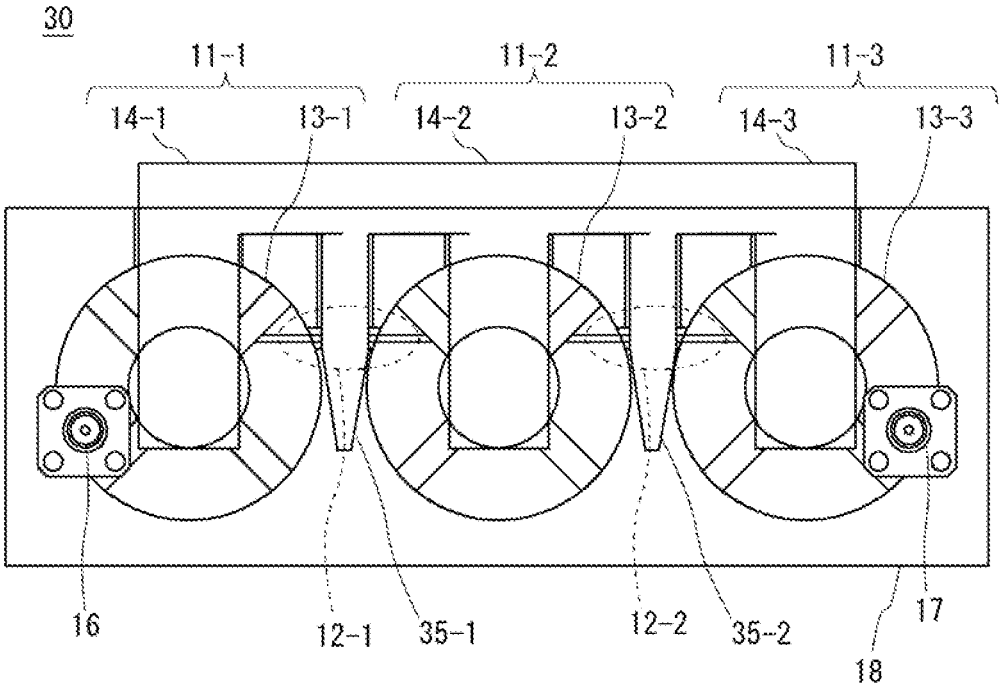
FIG. 11 is a partially transparent top view showing another configuration example of a frequency variable band-pass filter according to the third example embodiment.
Figure 12:
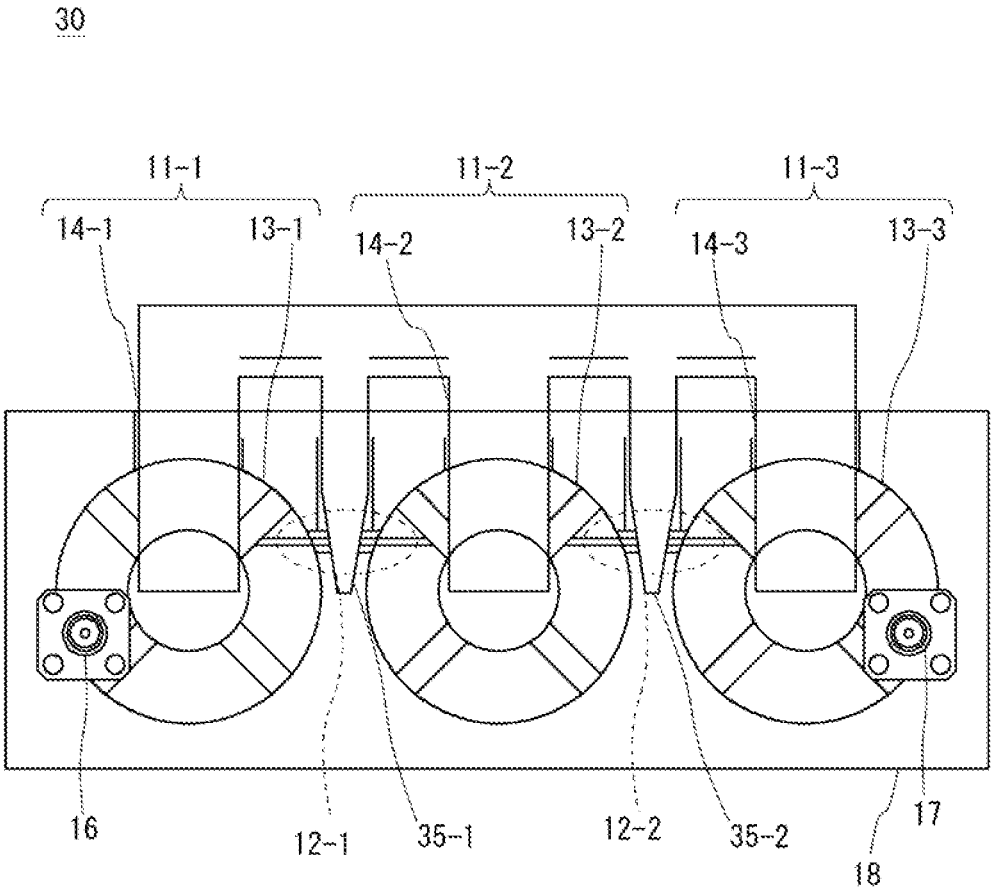
FIG. 12 is a partially transparent top view of the frequency variable band-pass filter of FIG. 11 when a position of a dielectric is changed.

FIG. 11 is a partially transparent top view showing another configuration example of the frequency variable band-pass filter according to this example embodiment. FIG. 12 is a partially transparent top view showing a state in which positions of dielectrics are changed in the frequency variable band-pass filter of FIG. 11.

As shown in FIGS. 11 and 12, a frequency variable band-pass filter 30 according to another configuration example of this example embodiment has a structure in which the frequency variable dielectrics 14 and the coupling variable dielectrics 15 are integrated, and has a characterized structure in order to independently control variable quantities of the frequency and coupling. In FIGS. 11 and 12, the coupling variable dielectrics 15 are illustrated as coupling variable dielectrics 35 (35-1 and 35-2).

Specifically, as shown in FIG. 11 when the frequency is low, and in FIG. 12 when the frequency is high, the frequency variable band-pass filter 30 can support the case in which the amounts of insertion of the dielectrics are different. When the frequency is low, the amount of overlap between the coupling parts 12 and the coupling variable dielectrics 35 is increased, and as the frequency increases, the amount of overlap between the coupling parts 12 and the coupling variable dielectrics 35 is decreased. By such control, the bandwidth of the frequency variable band-pass filter 30 can be made constant regardless of the frequency.

Such an increase or decrease in the amount of overlap between the coupling parts 12 and the coupling variable dielectrics 35 can be achieved by forming the coupling variable dielectrics 35 to have shapes whose cross-sectional areas perpendicular to the moving direction change. That is, it is possible to control the coupling coefficient with respect to the amount of insertion irrespective of the amount of movement of the frequency variable dielectric 14 by using a dielectric whose cross-sectional area is not uniform, for example, whose planar shape or other geometric shape is not uniform. Here, the coupling coefficient with respect to the amount of insertion corresponds to a variable width of the frequency with respect to the amount of insertion, an inclination of a pass frequency graph, and the like. The above example in which the cross-sectional area is not uniform can be applied to an example in which the frequency variable dielectrics 14 and the coupling variable dielectrics 15 are not integrally movable.

Figure 13:
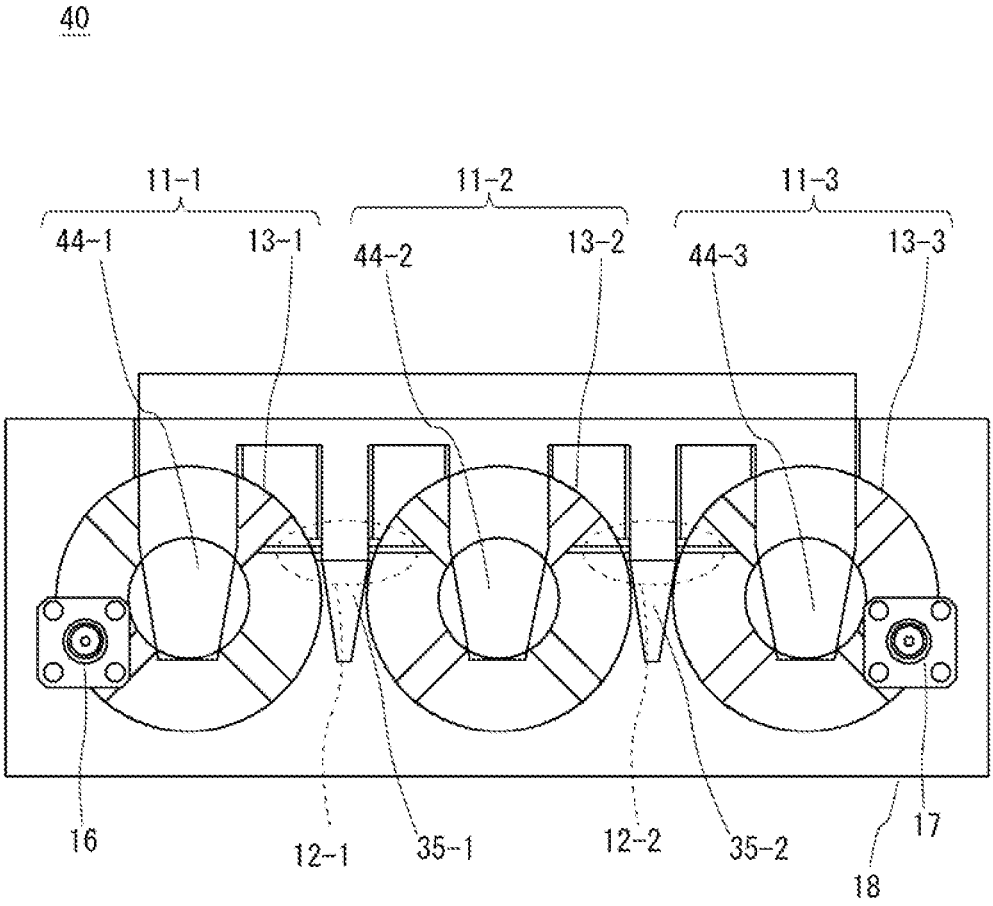
FIG. 13 is a partially transparent top view showing another configuration example of the frequency variable band-pass filter according to the third example embodiment.

FIG. 13 is a partially transparent top view showing another configuration example of the frequency variable band-pass filter according to this example embodiment. In FIG. 13, the frequency variable dielectrics 14 are illustrated as frequency variable dielectrics 44 (44-1, 44-2, and 44-3). As shown in FIG. 13, the frequency variable band-pass filter 40 according to another configuration example of this example embodiment is configured such that the shapes of the frequency variable dielectrics 44 are not uniform. This shape is not necessarily limited to a linear shape, but may be a curved shape if more precise control is desired.

As described above, by configuring at least one of the coupling variable dielectrics 15 and the frequency variable dielectrics 14 so that the cross-sectional areas perpendicular to the moving direction change, the frequency and the bandwidth can be controlled independently.

Figure 14:
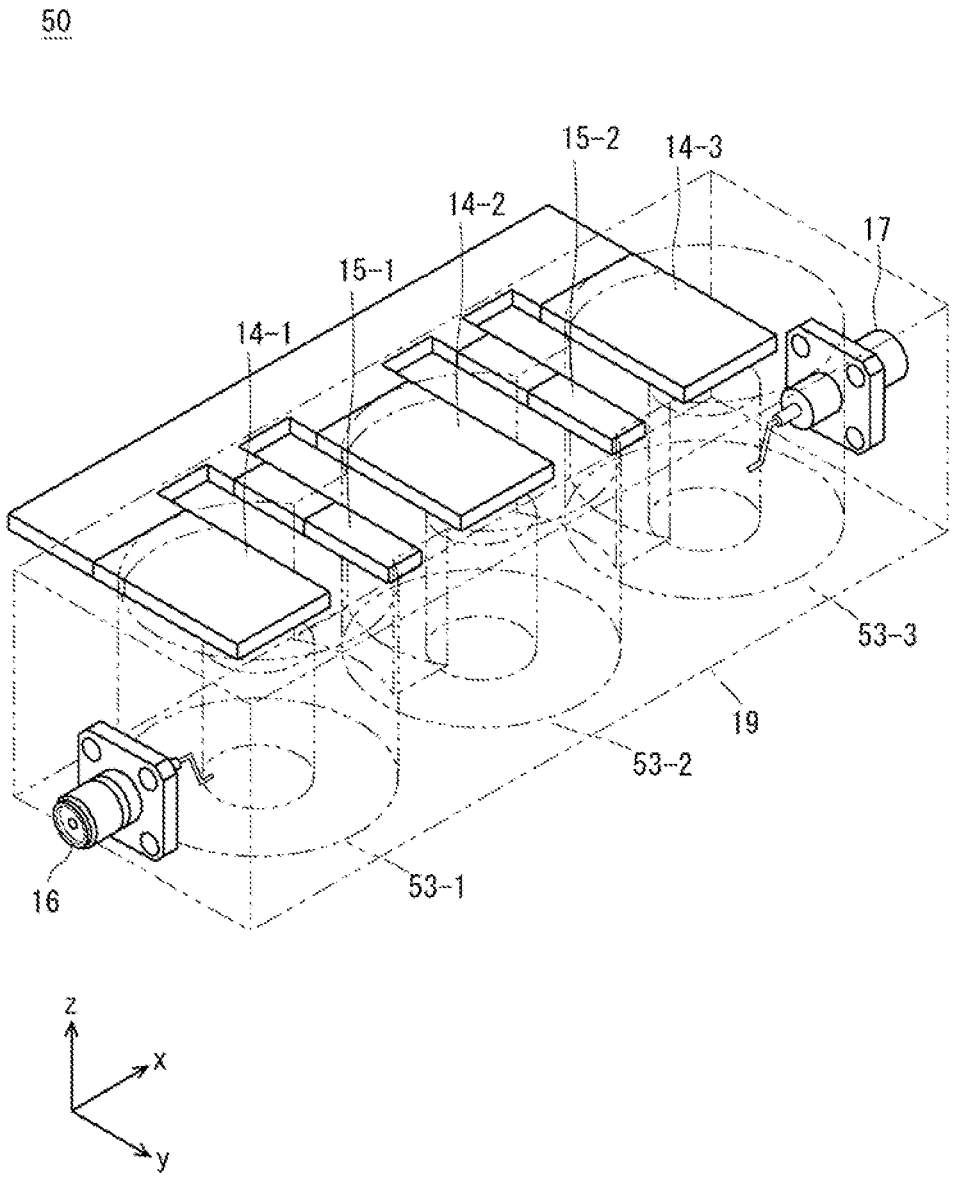
FIG. 14 is a partially transparent perspective view showing another configuration example of the frequency variable band-pass filter according to the third example embodiment.

FIG. 14 is a partially transparent perspective view showing another configuration example of the frequency variable band-pass filter according to this example embodiment. As shown in FIG. 14, a frequency variable band-pass filter 50 according to another configuration example of this example embodiment includes resonators having shapes different from those of the above example, specifically, semi-coaxial resonators 53 (53-1, 53-2, 53-3) are included. Also in FIG. 14, an outer conductor and the like are shown transparently in order to show an inner structure clearly. The semi-coaxial resonators 53 are configured to be in the TEM mode by each including a cylindrical outer conductor and a cylinder (an inner conductor) at the center thereof. In this way, even when the resonators are different, it is possible to control the bandwidth when the frequency is variable by inserting the coupling variable dielectrics 15 into the coupling parts 12. As shown in FIG. 14, the positions of the input/output terminals 16 and 17 are not limited to the positions shown in FIG. 2 and the like.

Although the present disclosure has been described above with reference to the plurality of example embodiments, the present disclosure is not limited to the example embodiments described above. Various modifications that can be understood by a person skilled in the art within the scope of the disclosure can be made to the configurations and details of the present disclosure.

For example, the features of each of the above example embodiments may be configured to be implemented separately from the features of other example embodiments. Further, the shapes, sizes, positional relationships, and the like of the components in the above-described example embodiments are not limited to those illustrated if the functions of the present disclosure can be implemented. Further, in the above example embodiments, an example in which the frequency variable filter according to the present disclosure is a frequency variable band-pass filter in which the passing center frequency is variable has been described. However, the present disclosure is not limited to this, and for example, the frequency to be adjusted may be a frequency other than the center frequency. The frequency variable filter according to the present disclosure may be a tunable band stop filter in which a stop frequency such as a stop center frequency is variable. The frequency variable filter according to the present disclosure can be applied to a mobile phone base station apparatus, a high frequency radio communication apparatus for communicating high-frequency signals in a microwave band or a millimeter wave band, or the like.

According to the present disclosure, it is possible to provide a frequency variable filter which has a simple structure and can be configured so as to have a function of easily changing a target frequency while suppressing a fluctuation of a bandwidth, and a method for coupling variable resonators in the frequency variable filter. According to the present disclosure, other effects may be produced instead of or in addition to such effects.

The first to third example embodiments can be combined as desirable by one of ordinary skill in the art.

While the disclosure has been particularly shown and described with reference to example embodiments thereof, the disclosure is not limited to these example embodiments. It will be understood by those of ordinary skill in the art that various changes in form and details may be made therein without departing from the spirit and scope of the present disclosure as defined by the claims.

What is claimed is:

1. A frequency variable filter comprising:

a plurality of variable resonators aligned in a predetermined direction and configured to be able to change a resonance frequency;

a coupling part configured to couple the adjacent variable resonators among the plurality of variable resonators; and a coupling variable dielectric disposed in a movable state with respect to the coupling part and configured to adjust a coupling coefficient according to an amount of insertion into the coupling part, wherein the variable resonators includes a resonator and a frequency variable dielectric disposed in a movable state relative to the resonator, and is configured to be able to change the resonance frequency according to a position of the frequency variable dielectric with respect to the resonator, and the coupling variable dielectric is disposed so that a movable surface of the coupling variable dielectric is on the same plane as a movable surface of the frequency variable dielectric.

2. The frequency variable filter according to claim 1, wherein the coupling variable dielectric is disposed so that a movable axis of the coupling variable dielectric is directed in the same direction as a movable axis of the frequency variable dielectric.

3. The frequency variable filter according to claim 1, wherein the coupling variable dielectric and the frequency variable dielectric are disposed in an integrally movable state.

4. The frequency variable filter according to claim 1, wherein at least one of the coupling variable dielectric and the frequency variable dielectric has a shape whose cross-sectional area perpendicular to the moving direction changes.

5. The frequency variable filter according to claim 1, wherein the coupling part is configured to be in a TEM (Transverse ElectroMagnetic) mode.

6. The frequency variable filter according to claim 1, wherein the coupling part constitutes a coaxial transmission line with an inner conductor and an outer conductor.

7. The frequency variable filter according to claim 1, wherein the resonators includes a Composite right/left-handed line.

8. The frequency variable filter according to claim 7, wherein the coupling part includes a structure in which the Composite right/left-handed lines in the adjacent resonators are directly connected to each other.

9. The frequency variable filter according to claim 1, further comprising a control unit configured to control the amount of insertion of the coupling variable dielectric according to a position of the frequency variable dielectric relative to the resonators so that a bandwidth to be passed becomes substantially constant irrespective of the position of the frequency variable dielectric relative to the resonators.

10. A method for coupling a plurality of variable resonators in a frequency variable filter including the plurality of variable resonators configured to be able to change a resonance frequency, the method comprising coupling and disposing, the variable resonators includes a resonator and a frequency variable dielectric disposed in a movable state relative to the resonator, and is configured to be able to change the resonance frequency according to a position of the frequency variable dielectric with respect to the resonator, the coupling is coupling the adjacent variable resonators among the plurality of variable resonators aligned in a predetermined direction, the disposing is disposing a coupling variable dielectric in a movable state with respect to a coupling part so that a coupling coefficient is adjusted according to an amount of insertion into the coupling part and disposing the coupling variable dielectric so that a movable surface of the coupling variable dielectric is on the same plane as a movable surface of the frequency variable dielectric.

* * * * *